343-754 SR

11/30/82 OR 4,361,841

United States Patent [19]

Cassel et al.

[11] 4,361,841

[45] Nov. 30, 1982

[54] LENS ANTENNA

[75] Inventors: Knut E. Cassel; Bengt T. Molin, both of Jarfalla, Sweden

[73] Assignee: U.S. Philips Corporation, New York, N.Y.

[21] Appl. No.: 144,727

[22] Filed: Apr. 28, 1980

[30] Foreign Application Priority Data

Feb. 6, 1979 [SE] Sweden ..... 7901047

[51] Int. Cl.[3] ..... H01Q 15/08

[52] U.S. Cl. ..... 343/754; 343/911 L

[58] Field of Search ..... 343/753, 754, 911 L, 343/911 R, 854

[56] References Cited

U.S. PATENT DOCUMENTS

| | | | |
|---|---|---|---|
| 2,875,439 | 2/1959 | Berkowitz | 343/911 L |
| 3,252,160 | 5/1966 | Karcer | 343/783 |
| 3,392,394 | 7/1968 | Caballero | 343/754 |
| 3,958,246 | 5/1976 | Wohlers et al. | 343/754 |
| 4,297,709 | 10/1981 | Cassel et al. | 343/911 L |

FOREIGN PATENT DOCUMENTS

| | | | |
|---|---|---|---|
| 874509 | 8/1961 | United Kingdom | 343/783 |

*Primary Examiner*—Eli Lieberman

*Attorney, Agent, or Firm*—Robert J. Kraus

[57] ABSTRACT

A lens antenna of Luneberg type comprising a disc-shaped dielectric element having a radially varying diffraction index and bounded on both major sides by conductive metal plates. The antenna is preferably adapted for transmission of a wave which is polarized in an angle of 45° relative to the plane of the lens element and is characterized in that the distance between the conductive plates and the lens element is filled with air or a dielectric having a corresponding dielectric constant.

7 Claims, 9 Drawing Figures

LENS ANTENNA

BACKGROUND OF THE INVENTION

The invention relates to a lens antenna, preferably operable within the micro wave range, comprising a round disc-shaped lens element, such as a round disc of dielectric plastic material, having a radially varying diffraction index (dielectric constant). The lens element is positioned between two conductive plates and has feeders distributed along at least a portion of the circumference. The feeders are so shaped and oriented that they are adapted to transmit or receive a polarized wave having a polarization direction which forms an angle deviating from 90°, preferably 45°, with the major surfaces of the lens element.

Such a wave includes an E-component which is parallel with the lens plane and an E-component which is perpendicular to the lens plane. If the lens is oriented horizontally, the components are horizontal and vertical. These components are subject to diffractions and delay (phase displacement) in the lens. The dielectric constant of the disc is highest at the center and decreases with a distance from the center by a factor which is substantially proportional to the square of the normalized radial distance from the center. In order for the horizontal component to be effectively transmitted, limitations are placed on the total thickness or height of the lens, i.e. the distance between the conductive plates. However, in order to effectively transmit the vertical component, the thickness or height of the lens can be selected substantially arbitrarily. In the case of transmission of the horizontal component, cut-off appears at a lens thickness equal to $\lambda/2$, where $\lambda$ is the wave length, and the total thickness of the lens must thus exceed half the wave length at the lowest frequency in order to be able to transmit a horizontal component. There are also requirements that cross polarisation and sidelobes are suppressed. Cross polarisation is phase deviation between horizontal and vertical components which are transmitted through the same aperture. Effective cross polarization suppression requires that the horizontal and vertical components of a 45° polarized wave transmitted through the lens have a phase difference which is near an integer times $2\pi$ radians. Improved phase equality between horizontal and vertical components, and thereby improved cross polarization suppression, is obtained by increasing lens height. Sidelobes are caused by i.a. irregularities in the transmission phase rotation, i.e. the presence of radiation paths of different electrical lengths through the lens between its focal points and corresponding apertures. Effective sidelobe suppression requires an even phase shift across the aperture of the lens, so that the central and the peripheral rays in the lens have little phase distortion. Also, sidelobe suppression increases with lens height, because the radial distribution of the dielectric constant for vertical and horizontal E-components differ more for lenses with small height.

An increase of the lens height, however, results in a decrease of the radiation angle covered by the antenna in a plane perpendicular to the plane limiting surfaces of the lens (or the vertical plane in the given example with horizontal lens). Thus a small height is desirable for a large radiation angle. A small lens height is also desirable for preventing higher modes, which cause an unfavourable field distribution, because these increase with increasing lens height. Finally, a large lens height necessitates an increase in the plastic volume (in a lens filled with dielectric plastic material) and thereby an increased price and weight and increased space.

Thus requirement for high cross polarization suppression and high sidelobe suppression is contrary to the requirement for a large radiation angle in the plane perpendicular to the lens plane, suppression of higher modes and the minimization of weight, size and price.

SUMMARY OF THE INVENTION

An object of the invention is to decrease the lens height and to thereby achieve the advantages which are associated with small lens height, while maintaining the advantages which are associated with a higher (or thicker) lens.

According to the invention this is achieved by constructing the antenna such that a portion of the distance between the two conductive planes is formed from air or a dielectric having a corresponding dielectric constant and selecting the height of the air space relative to the height of the disc shaped lens element that an E-field component parallel to the lens plane undergoes substantially the same total phase shift, or a phase shift deviating an integral multiple of $2\pi$, as an E-field component perpendicular to the lens plane, during transmission through the lens.

The invention relies basicly on the recognition that by filling the space between the conductive planes only partially with a dielectric having a dielectric constant which varies as a function of its radius, or with any other lens functioning in accordance with the Luneberg principle, and by filling the remainder with air, it is always possible to find a ratio between the height of the air space and the height of the dielectric such that the two components, e.g. vertical and horizontal components, respectively, will leave the lens substantially in phase. That is, both components will undergo the same phase shift during transmission through the lens, or a phase shift differing 360° from each other, and this will be effected by an antenna having a total lens height which is smaller than that of an antenna which is completely filled with dielectric. Thus, while maintaining good cross polarization suppression and sidelobe suppression, the lens according to the invention will have reduced volume and weight and furthermore exhibit the advantages which are connected with small height.

A first embodiment of the invention is characterized in that both the conductive plates and the adjacent surfaces of disc shaped element define planes which are arranged parallel to each other so that the air space (or air spaces) is (are) of constant height throughout the lens and the total height of the air space (or air spaces) is of the same magnitude as the height of the disc-shaped element. In this configuration the height of the lens, i.e. the total distance between the conductive planes, will be approximately half the height of a lens which is completely filled with dielectric. Because the height of the dielectric disc in an antenna constructed according to the invention is approximately half the total lens height, this disc will be approximately four times thinner than that of a completely filled lens.

In one form of this embodiment the disc-shaped lens element is situated half way between the conductive plates so that equally-large air gaps are formed on each side of the lens element. The air gaps are so dimensioned relative to the lens element that at the center of the lens there is a difference between the resulting dielectric constant for a wave having its E-field vector in parallel with the lens plane and for a wave having its E-field vector perpendicular thereto, which difference is substantially compensated by a corresponding difference between the dielectric constants for the two vectors at the circumference, but which is of opposite sign.

This embodiment provides a lens of high pass character. At the center of the lens the phase velocities for horizontal and vertical components are different in one sense and that at the circumference they are different in the opposite sense. Thus it is possible to find such a ratio between the height of the air space and the height of the dielectric disc that the differences in resulting phase shift caused by the differences in phase velocities will substantially "cancel each other" and the horizontal and vertical components will leave the lens with a small phase difference. This holds true over a very wide frequency range, on the order of a number of octaves, above the cut-off frequency.

A second form of the plane-shaped embodiment is characterized in that the disc-shaped lens element is in contact with one of the planar conductive plates, so that a single air gap is formed between the opposite side of the disc shaped element and the opposite planar conductive plate. The air gap is so dimensioned relative to the lens element that there is a difference between the resulting dielectric constant for a wave having its E-field vector in parallel with the lens plane and the resulting dielectric constant for a wave having its E-field component perpendicular thereto, which difference is substantially constant from the center of the lens to the circumference and corresponds to a difference in total phase shift for the two waves which is substantially equal to $2\pi$.

This embodiment provides a lens of band pass character. The effective dielectric constant is appreciably larger for the vertical component than for the horizontal component both at the center of the lens and at the circumference. Thus it is possible to find such a ratio between the height of the air gap and the height of the dielectric disc that the resulting difference in phase shift for the two components will be approximately 360°. This also holds true over a wide frequency range, on the order of one or two octaves.

Although the above-described simple planar embodiments produce satisfactory transmission of both the horizontal and vertical components, it is also possible, without deviating from the basic concept of the invention, (i.e. a combination of dielectric with radially varying dielectric constant and an air gap between the conductive planes) to optimize the lens dimensions. Computer calculations make it possible to achieve almost complete equality between the phase velocities for vertical and horizontal components in each point of the lens. This is accomplished by varying the height of the air space in the radial direction, resulting in equal total phase shift for the two components, and further resulting in a variation of the dielectric constant with increasing distance from the center that coincides with the variation prescribed by Luneberg.

Another preferred embodiment of the invention is therefore characterized in that the conductive plates and/or the disc-shaped lens element are so shaped that the height of the air gap or air gaps vaires radially from a minimum value at the center of the lens to a maximum value at the circumference according to a continuously increasing function. This height is selected such that for each radial distance from the center the resulting dielectric constant for a wave having its E-field component in parallel with the lens surface is substantially equal to the resulting dielectric constant for a wave having its E-field vector perpendicular to the lens surface.

By a somewhat more complex shape of the lens it has thus been achieved that the resulting or effective dielectric constant for the two waves is substantially equal in each point of the lens, whereby the total phase shift for the two waves will also be equal.

Preferably the disc-shaped lens element is situated half way between the conductive plates so that an equally large air gap is formed on each side of the disc-shaped element, which gaps widen from the center to the circumference of the lens.

In this preferred embodiment the varying width of the air gaps can be achieved in different ways, such as by bending the conductive plates to a convex shape as seen from the air gaps, or by forming the major surfaces of the disc-shaped lens element into a convex shape, or by a combination of both measures.

These preferred embodiments also give the same advantages as regards small lens height, small space requirements and low weight as the previously described embodiments.

BRIEF DESCRIPTION OF THE DRAWING

The invention is explained in more detail with reference to the drawing, in which.

DESCRIPTION OF THE PREFERRED EMBODIMENTS

Figure 1:
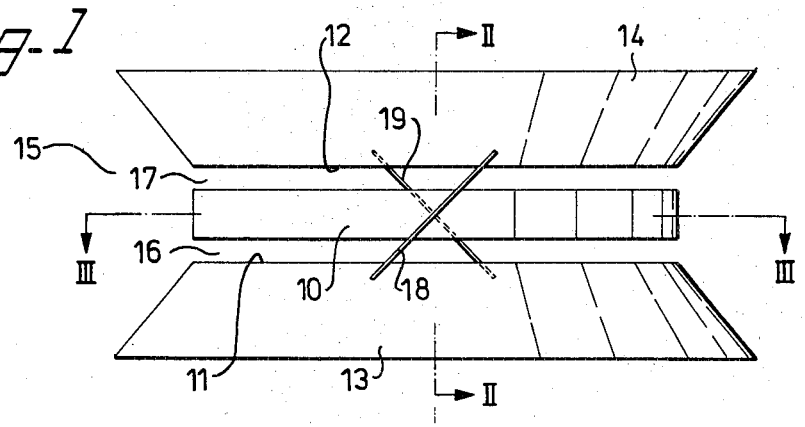
FIG. 1 shows a side view of a first embodiment of a lens antenna according to the invention.
Figure 2:
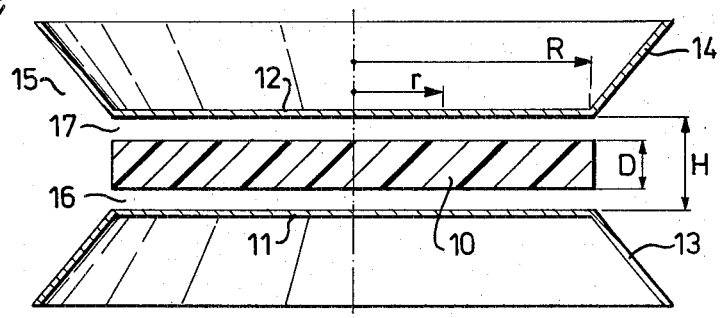
FIG. 2 shows a vertical sectional view through the lens taken along the line II—II.

The lens antenna according to FIGS. 1 and 2 comprises a circular disc 10 of dielectric plastic material having a dielectric constant which increases toward the center of the disc. The disc is situated half way between two circular metal plates 11 and 12. At its circumference each metal plate continues in an angular collar 13, 14 having the shape of a truncated cone. Between themselves, the collars define a funnel shaped space 15 extending round the whole circumference. The antenna is adapted for transmission of radiation which is polarised 45° relative to the lens plane, and is provided with at least one feeder for such polarised radiation at its circumference. The feeders may, for example, cover the whole circumference and be shaped as described in the Swedish patent application No. 7901046-8, which is hereby incorporated by reference. The feeders are, according to this patent application, wire-shaped and are each situated in a plane which, as seen radially, forms a 45° angle with the lens plane. Two such wire-shaped feeders designated 18 and 19 are indicated in FIG. 1, the feeder 19 being situated at the rear side of the lens. The feeders are symmetric and feeding is effected in the central point.

Figure 3:
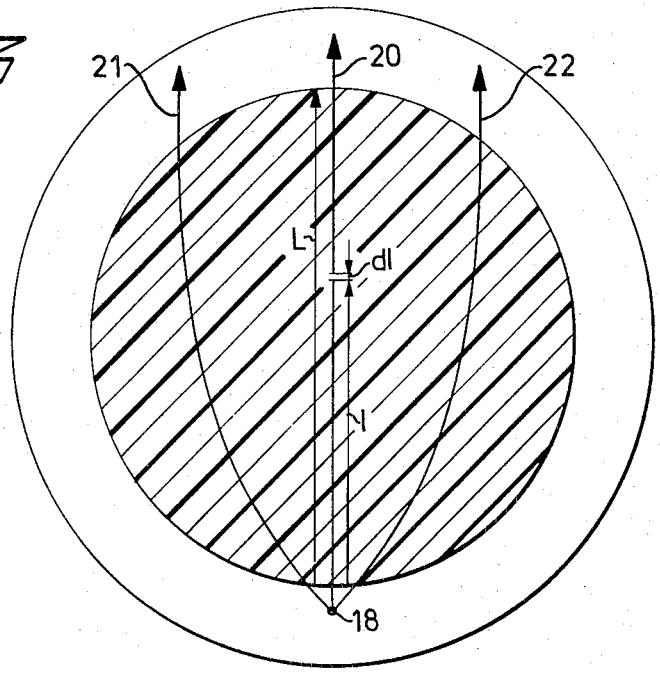
FIG. 3 shows a horizontal sectional view through the lens taken along the line III—III in FIG. 1 with three radiation paths shown.

FIG. 3 shows the radiation in the horizontal plane for the feeder 18, reference numeral 20 designating the central ray and 21 and 22 the two outermost rays in the lobe.

As is evident from FIGS. 1 and 2, the thickness D of the disc 10 which is placed halfway between the conductive plates 11, 12 is essentially smaller than the distance H between the conductive metal plates 11 and 12 so that equally large air gaps 16, 17 which may be filled with a dielectric foam are formed on each side of the disc 10. Experiments have shown that optimal dimensioning is obtained if the thickness D of the disc 10 is of the same magnitude as the total thickness of the air gaps 16, 17. In the present example it is assumed that the dielectric disc itself is optimally dimensioned for a vertical polarized wave in accordance with the equation for a lens of so-called Luneberg type, i.e. that $$\epsilon(r)=2-(r/R)^2$$

where $\epsilon(r)$ is the dielectric constant, r is the distance from the center of the lens, and R is the radius of the disc 10. One example of suitable dimensions are:

$D=0.6\lambda$
$H=1.1\lambda$
$R=8\lambda$ where $\lambda$ is the wavelength in free space.

Figure 5:
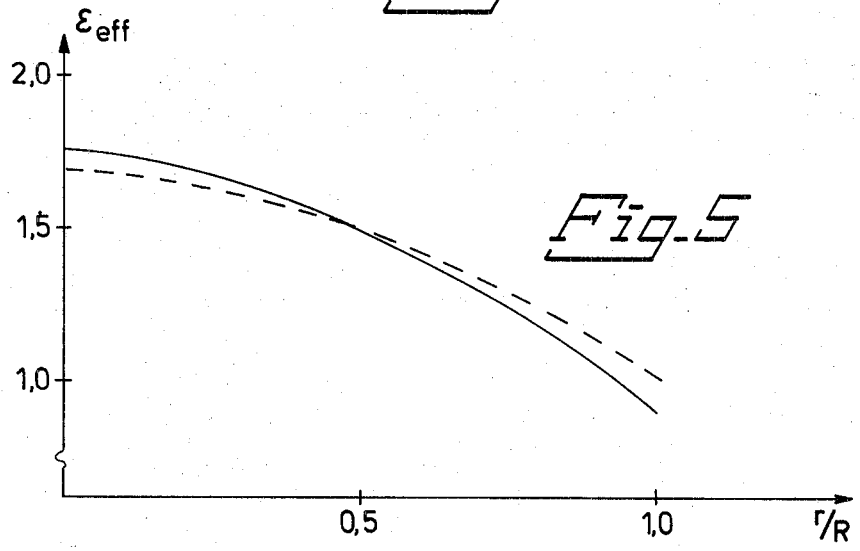
FIG. 5 shows a curve for the variation of the effective dielectric constant with the distance from the center of the lens according to FIGS. 1 and 2, provided that the dielectric disc is optimally dimensioned for vertical polarization.

The combination of the dielectric disc and the two air gaps on each side of the disc produces in each point of the lens a resulting or effective dielectric constant $\epsilon_{eff}$ which differs from the dielectric constant $\epsilon(r)$ for the disc alone. For the above given dimensions of the dielectric disc (in the example optimal Luneberg dimensioning for the vertical component is assumed) and the air gaps an $\epsilon_{eff}$ is obtained for the embodiment shown in FIGS. 1 and 2 as a function of r/R which is shown in FIG. 5. The dotted line in FIG. 5 shows the effective dielectric constant $\epsilon_{eff}$ for the vertical component and the solid line shows the dielectric constant $\epsilon_{eff}$ for the horizontal component. FIG. 5 is valid for a central ray but similar relationships will also be valid for other rays. It is evident from the Figure that $\epsilon_{eff}$ for the horizontal component is higher in the center of the lens ($r/R=0$) than $\epsilon_{eff}$ for the vertical component, while the opposite relationship prevails at the circumference of the lens ($r/R=1$). The total phase rotation $\phi$ for a wave from a feeder to the aperture at the opposite side of the lens is given by the expression:

$$\phi = -\int_O^L \frac{360\cdot\sqrt{\epsilon_{eff}}}{\lambda}\cdot dl$$

where l is the variable distance along the radiation path and L is the total length of the radiation path. It is obvious that the difference in phase rotation of the horizontal and vertical component for the actual central ray in the lobe, caused by the difference in $\epsilon_{eff}$ at the center of the radiation path (center of the lens), is counter-acted by the difference in phase rotation of the horizontal and vertical components, caused by the difference in $\epsilon_{eff}$ at the outer edges of the lens. For certain dimensions the horizontal and vertical components will leave the lens with approximately equal phases, which is desireable. This has been verified by practical experiments which have shown that, if optimal dimensioning has been achieved so that the phase difference between the vertical and horizontal components in the aperture of the antenna is zero or very small at a given frequency, this phase equality is maintained with sufficient accuracy (phase difference smaller than 30°) within a very wide frequency range covering a number of octaves. The antenna has in this case high a pass characteristic.

The deviation in the resulting or effective dielectric constant $\epsilon_{eff}$ relative to the ideal constant for a Luneberg lens ($\epsilon=2$ in the center of the lens and 1 at the periphery) causes the focus points to be displaced from the periphery of the disc. The feeders which shall be placed in the focus points are therefor placed outside the periphery.

Figure 4:
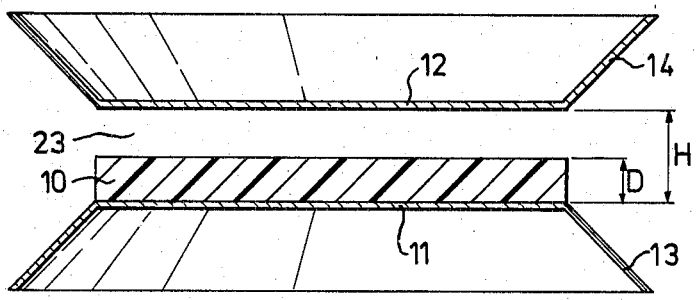
FIG. 4 shows a vertical sectional view of another embodiment of the lens antenna according to the invention.

FIG. 4 shows a second embodiment of the invention where the dielectric disc 10 lies directly against the lower conductive plate 11, so that one single air gap 23 is formed above the disc 10. The horizontal dielectric disc 10 is again assumed to be optimally dimensioned as prescribed by Luneberg for a horizontal disc lens adapted for a vertically polarised wave. Thus it has a dielectric constant following the previously given relationship.

An example of geometrical dimensions for this embodiment is as follows:

$D=0.5\lambda$
$H=1.3\lambda$
$R=8\lambda$

Figure 6:
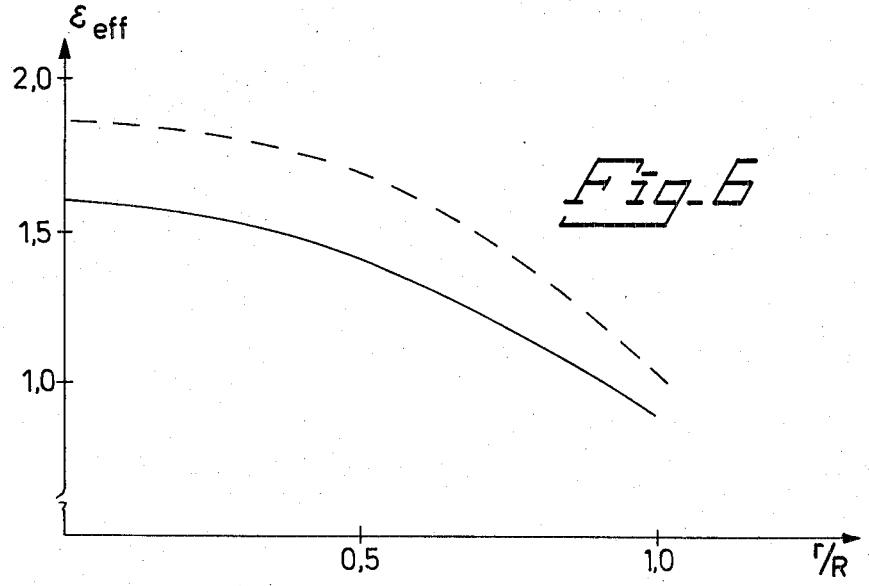
FIG. 6 shows a corresponding curve for the embodiment according to FIG. 4.

A determination of the resulting or effective dielectric constant $\epsilon_{eff}$ for the combination of dielectric disc and air gap, as a function of the distance from the center of the lens, for the given dimensions and for a central ray in the lobe gives the result shown in FIG. 6. Here the solid line represents the dielectric constant for the horizontal component and dotted line represents the dielectric constant for the vertical component.

It is evident that the effective dielectric constant $\epsilon_{eff}$ for the vertical component in this case is higher than the corresponding effective dielectric constant for the horizontal component, and that the difference between the dielectric constants is substantially constant from the center of the lens to the periphery. The curves shown are valid for a central ray in the lobe but similar relationships will also be valid for peripheral rays. The vertical component will thus be delayed more than the horizontal component. For a certain dimension of the antenna the vertical component will leave the lens $2\pi$ electrical radians later than the horizontal component and the two components will thus be in phase in the aperture, which is desirable. This is approximately true across the whole aperture. When such optimal dimensioning has been acheived this relationship of approximately no phase difference or an acceptable phase difference between horizontal and vertical component (<35°) will be maintained over a wide frequency range, on the order of 1–2 octaves. The antenna has in this case a band pass characteristic.

Figure 7:
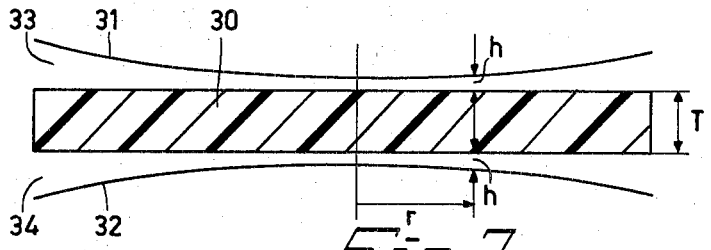
FIG. 7 shows a sectional view of a preferred embodiment of a lens antenna according to the invention, in which the height of the air gaps varies in the radial direction.

FIG. 7 shows a sectional view of the lens part of an antenna according to the invention, in which the dielectric disc 30 is arranged half way between two conductive plates 31 and 32, so that two equally large air gaps 33 and 34 are formed on the sides of the disc 30. In this case the air gaps are not constant, but have a height h varying with the distance r from the center of the lens. More specifically, the height h of the air gaps varies from a minimum value at the center of the lens to a maximum value at the circumference according to a smooth curve.

Figure 8:
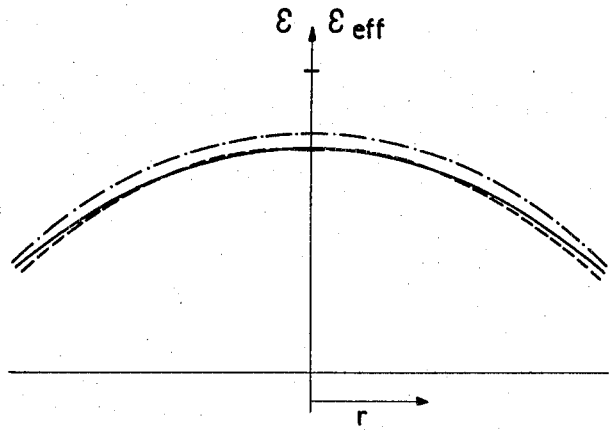
FIG. 8 shows the variation in dielectric constant with distance from the center for the lens antenna of FIG. 7.

FIG. 8 shows by a solid line and a dashed line the resulting or effective dielectric constant $\epsilon_{eff}$ for vertical and horizontal components, respectively, in the lens antenna of FIG. 7. For comparison, the dashed-and-dotted line shows the dielectric constant $\epsilon$ for the dielectric disc 30 alongside. As is evident from FIG. 8 the effective dielectric constant for the two waves is substantially equal at each point in the lens, whereby the resulting phase shift will also be equal.

The height h of the air gaps 33, 34 relative to the height or thickness T of the dielectric disc 30 is determined for different distances r from the center by computer calculation, such that maximal equality is obtained between the effective dielectric constants for vertical and horizontal components at each point in the lens, and also such that the variation in the effective dielectric constant as a function of the distance r closely follows the variation prescribed by Luneberg. As previously stated the desired equality has been achieved to a very high degree and this is valid for substantially the whole frequency band. Not until the lowest part of the frequency band, where the cut-off frequency for the horizontal component is approached, will there be noticeable deviations from the required equality.

Figure 9:
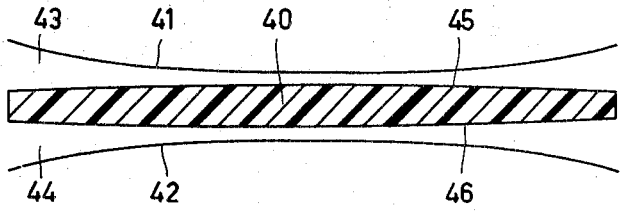
FIG. 9 shows a sectional view through an antenna construction, which is an alternative to that shown in FIG. 7.

FIG. 9 shows an alternative construction to that shown in FIG. 7, where the varying heights of the air gaps 43 and 44 on each side of the dielectric disc 40 has been achieved by making both major surfaces 45, 46 of the dielectric disc of convex shape. The conductive plates 41 and 42 can be of convex shape as shown, or alternatively be of plane shape. This will give substantially the same result as described for the embodiment according to FIG. 7. In principle one of the conductive plates adjacent of the major surfaces of the disc-shaped lens element can also be of planar shape.

The invention is not restricted to the use of a dielectric disc with radially varying dielectric constant as the lens element, but other elements can also be used within the scope of the invention. For example an element built-up as an artificial dielectric or any other type of lens element working according to the Luneberg principle may be used.

We claim:

1. An antenna comprising two conductive plates, feeders distributed around the periphery of the plates, and a lens including a disc-shaped lens element positioned between the plates, said feeders being oriented to transmit and receive waves polarized in a direction forming an angle of less than 90° with a major surface of the lens element, and said lens element having a radially-varying diffraction index in accordance with the Luneberg principle, wherein a portion of the distance between the two conductive plates is filled with a dielectric medium having a dielectric constant corresponding to that of air, and where the height of said dielectric medium varies relative to the height of the lens element, such that maximal equality is obtained between effective dielectric constants for a wave's E-field component which is parallel to the lens element major surface and the wave's E-field component which is perpendicular to the lens element major surface, at each point in the lens.

2. An antenna as in the claim 1, wherein the conductive plates and the disc-shaped lens element are so shaped that the height of the dielectric medium varies radially from a minimum value at the center of the lens to a maximum value at the circumference according to a continuously increasing function.

3. An antenna as in claim 2, wherein at least one of the conductive plates is of convex shape, as seen from the dielectric medium, to enable the height of the dielectric medium to be radially varied.

4. An antenna as in claim 2, wherein at least one of the major surfaces, of the disc-shaped lens element is of convex shape, to enable the height of the dielectric medium to be radially varied.

5. An antenna as in claim 3 or 4, wherein both the conductive plates and the major surfaces of the disc-shaped lens element are convex shaped.

6. An antenna as in any one of claims 2–4, characterized in that the disc-shaped lens element is situated half way between the conductive plates and where two equally-large dielectric mediums are positioned on opposite sides of the disc-shaped element, said mediums each widening in direction from the center to the circumference of the lens.

7. An antenna as in any of claims 1–4 wherein the feeders have the shape of thin wires which are distributed around the whole circumference of the antenna, each feeder lying in a plane forming a 45° angle with the plane of the major surfaces of the disc-shaped lens element and being bent to a symmetric shape in its own plane, feeding being effected in the symmetry point.

* * * * *